US005117464A

United States Patent [19]

Jones et al.

[11] Patent Number: 5,117,464

[45] Date of Patent: May 26, 1992

[54] ADJUSTABLE CLIP-ON HEADPHONES

[76] Inventors: Edward I. Jones, 391 Chestnut Hill Rd., Farmington, N.H. 03835; Gregory Wilson, 64 Chestnut Hill Rd., Rochester, N.H. 03835

[21] Appl. No.: 666,345

[22] Filed: Mar. 8, 1991

[51] Int. Cl.[5] ..... H04R 25/00

[52] U.S. Cl. ..... 381/183; 381/187; 381/25; 379/430; 181/129

[58] Field of Search ..... 381/187, 183, 25, 68.5; 181/128, 129, 133, 136; 379/430

[56] References Cited

U.S. PATENT DOCUMENTS

| | | | |
|---|---|---|---|
| 2,946,860 | 7/1960 | Jansen et al. | 181/129 |
| 3,856,007 | 12/1974 | Leight . | |
| 3,862,379 | 1/1975 | Pless . | |
| 4,321,433 | 3/1982 | King . | |
| 4,445,005 | 4/1984 | Furuhashi . | |
| 4,455,457 | 6/1984 | Akira | 181/141 |
| 4,499,593 | 2/1985 | Antle | 381/25 |
| 4,517,418 | 5/1985 | Baran et al. . | |
| 4,542,803 | 9/1985 | Houng | 381/183 |
| 4,571,746 | 2/1986 | Gorike | 381/251 |
| 4,776,044 | 10/1988 | Makins | 381/187 |
| 4,829,571 | 5/1989 | Kakiuchi | 381/25 |
| 4,888,805 | 12/1989 | Karppala, Jr. | 381/25 |
| 5,033,094 | 7/1991 | Hung | 381/183 |
| 5,035,005 | 7/1991 | Hung | 381/183 |

*Primary Examiner*—Jin F. Ng
*Assistant Examiner*—Huyen D. Le

[57] ABSTRACT

Stereo speakers 30 can be disconnected from a cross-over headband 10 and clipped onto a variety of head-wear in use today, such as a baseball cap, sweatband or sunvisor. A spring-loaded base piece and socket 24 allows the speaker 30 to adjust at an angle perpendicular to the user's ears and rotate 360 degrees laterally to the ear without removing the speakers from the head.

1 Claim, 5 Drawing Sheets

ADJUSTABLE CLIP-ON HEADPHONES

BACKGROUND OF THE INVENTION

A. Field of the Invention

This invention relates to stereo headphones and how they attach and adjust to the head.

B. Description of the Prior Art

Prior art research has shown a number of different methods for attaching stereo speakers to the head. The speakers have limited adjustment and are limited to a specific type of headwear. U.S. Pat. No. 3,856,007 to Leight (1974) shows a mount for eyeglasses that has an adjustable socket. It can only pivot away from the user's ear and can only mount to eyeglasses. U.S. Pat. No. 4,499,593 to Antle (1983) shows a set of headphones that has replaceable snap-together speakers. It doesn't allow the speakers to be attached to anything other than a specific headband. U.S. Pat. No. 4,517,418 to Baran, Besasie, Warren, Montgomery (1985) shows a set of portable headphones with a number of operating positions. It doesn't allow the speakers to be disconnected from the headband, and it doesn't allow the speakers to be pivoted away from the user's ears when not in use.

Thereafter U.S. Pat. No. 4,776,044 Makins (1988) shows how a set of audio earphones is mounted in the ear flaps of a specific hat. However, it is limited to that hat. U.S. Pat. No. 4,888,805 to Karppla Jr. (1989) shows an adjustable mounting system. It must be used with eyeglasses and provides only lateral adjustment.

All of these prior patents suffer from a number of disadvantages:

(a) Speakers are limited to a specific type of headwear.

(b) Speakers can't be removed and clipped to a different type of headwear.

(c) The speakers can't pivot away from the user's ear when not in use and while still attached to the head.

(d) The speakers don't provide enough adjustment for maximum fit and comfort between the speakers and the user's ear required for mounting to different types of headwear.

SUMMARY OF THE INVENTION

Accordingly the objects and advantages of the present invention are:

(a) The headphones can be used like conventional headphones in use today.

(b) The need for a crossover headband is eliminated. The speakers can be detached from the headband and clipped to any type of headwear.

(c) The speakers can be pivoted away from the user's ears at an angle perpendicular to the ear when not in use and without removing the speakers from the head. The speakers can rotate 360 degrees laterally tot he ear and can be adjusted up and down.

Adjustable clip-on headphones provide a limitless number of mounting alternatives. They provide maximum adjustability for maximum fit and comfort between the ear and speaker regardless of the type of headwear to which they are attached.

DRAWING FIGURES

DESCRIPTION

FIGS. 1-7

Figure 1:
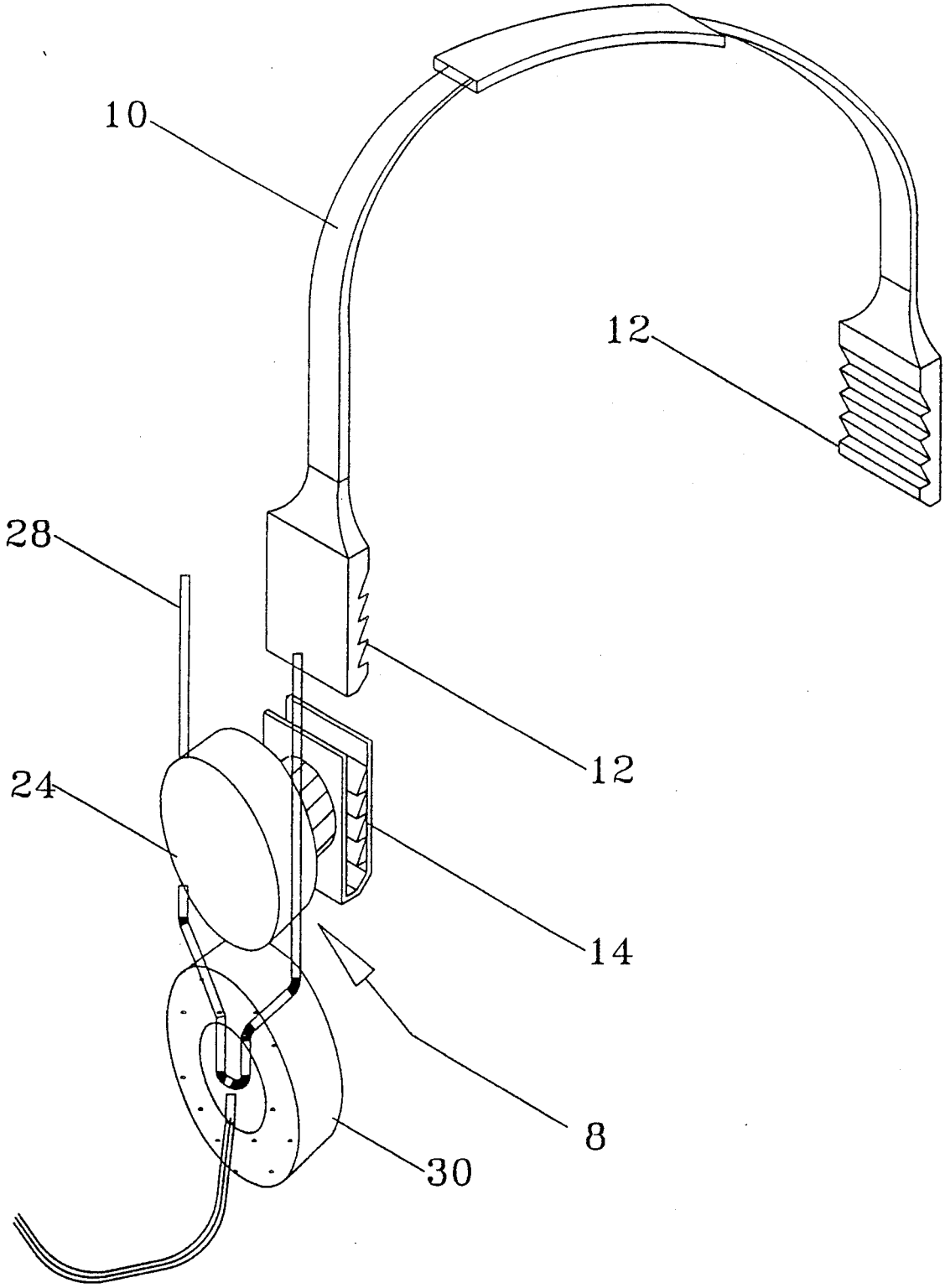
FIG. 1 is a perspective view of the invention aligned for interconnection.

The perspective views shown in FIG. 1 are the preferred embodiments of an adjustable clip-on headphone system 8. The right side and left side are identical. One side is shown. A metal or plastic crossover headband 10 is equipped with male clip mounts 12. A molded plastic base piece and socket 24 equipped with female clip 14, spring steel slide speaker rods 28 and a speaker 30 interconnect to form adjustable clip-on headphone 8.

Figure 2:
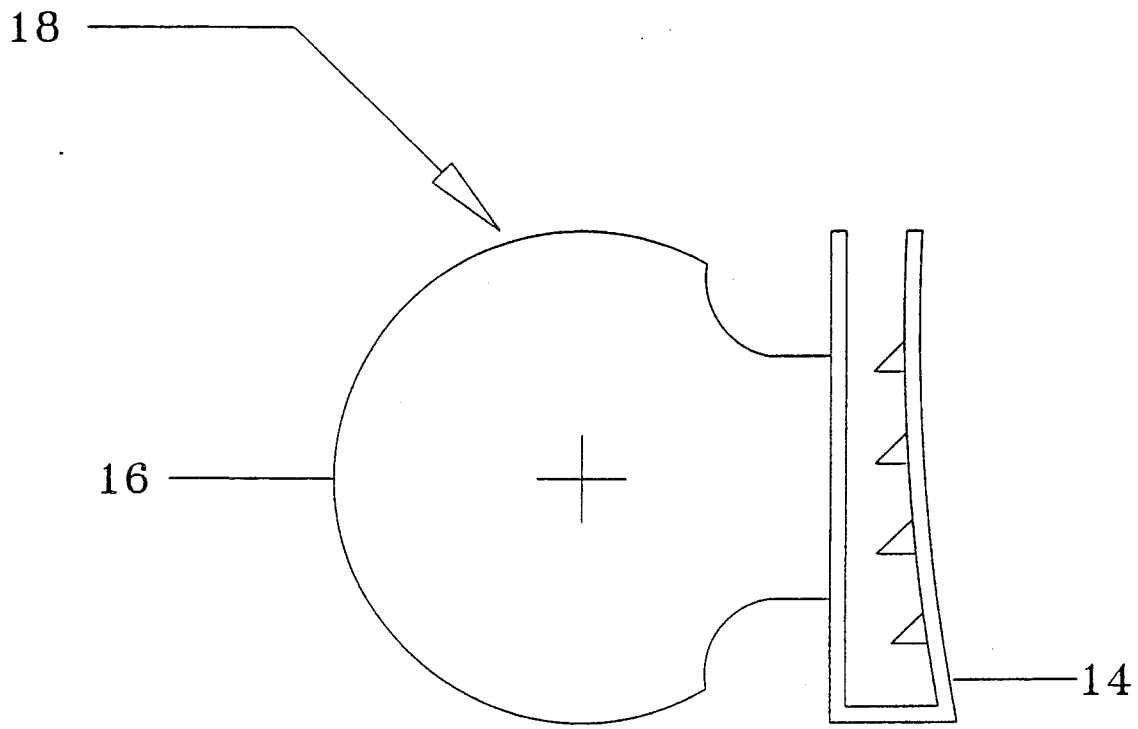
FIG. 2 is a base piece.

A plastic female clip 14 is molded to a plastic ball 16 and forms a base piece 18 shown in FIG. 2.

Figure 3:
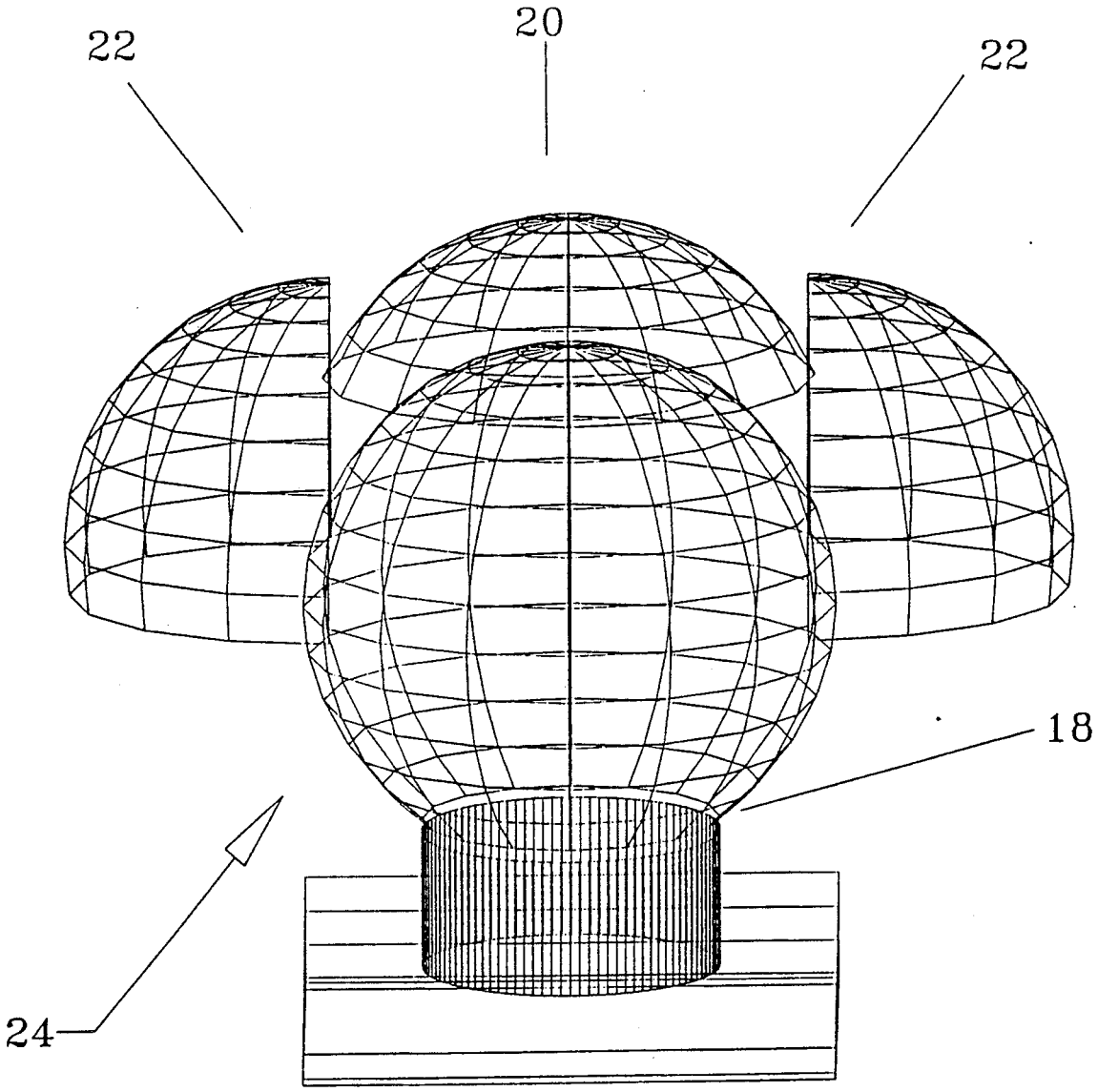
FIG. 3 is an exploded view of a base piece, spring and socket.

FIG. 3 is an exploded view of base piece and socket 24. Two halves of molded plastic socket 22, a metal spring 20 and base piece 18 interconnect to form base piece and socket 24.

Figure 4:
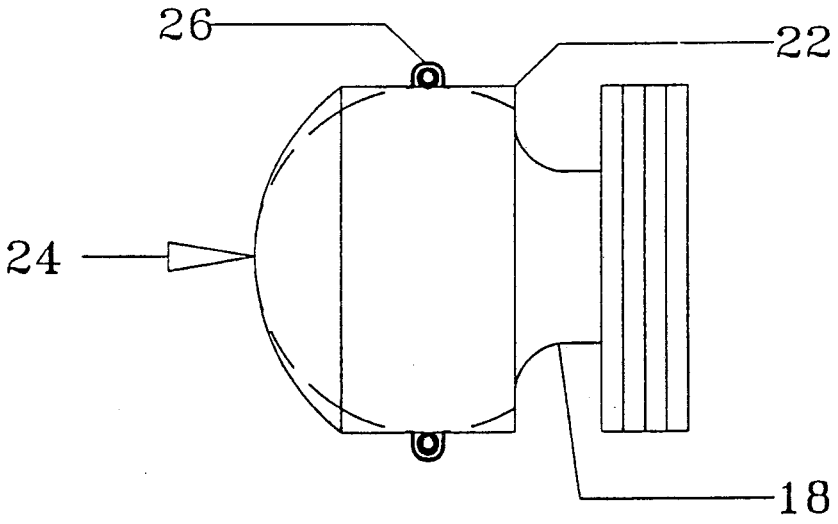
FIG. 4 is a top view of assembled base piece and socket.
Figure 5:
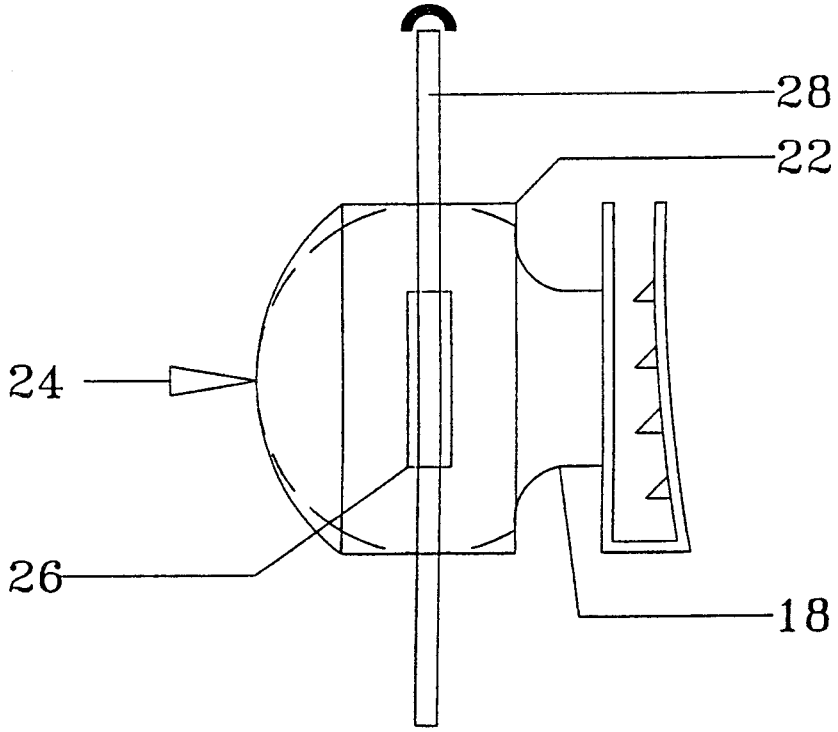
FIG. 5 is a side view of base piece and socket.

Assembled base piece and socket 24 in FIG. 4 (a top view) shows slide rod guides 26 molded to socket 22. FIG. 5 (a side view) shows spring steel glide speaker rod 28 riding in guide 26 of base piece and socket 24.

Figure 6:
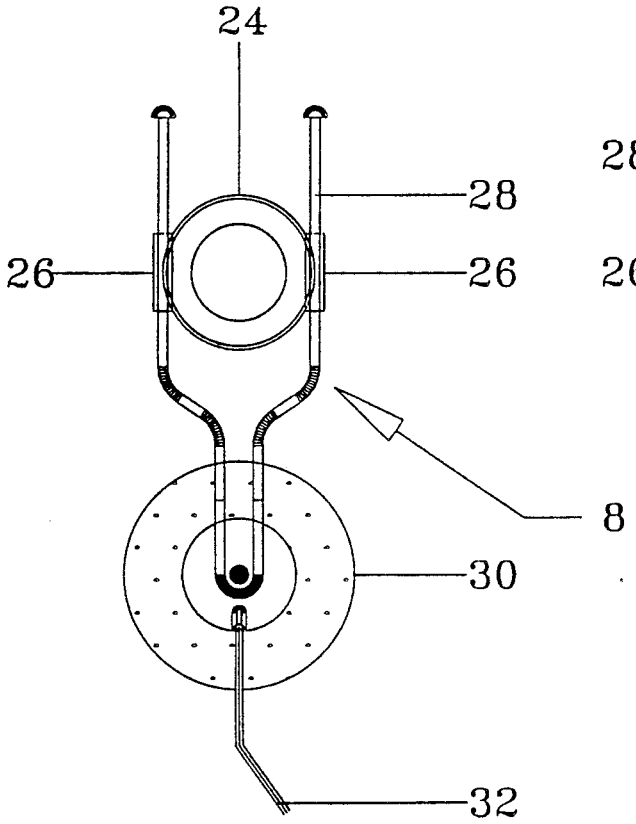
FIG. 6 is a front view of adjustable clip-on headphone.
Figure 7:
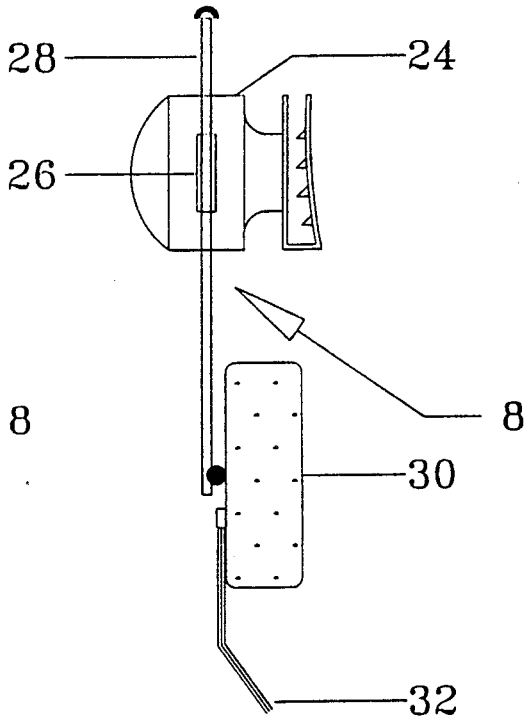
FIG. 7 is a side view of adjustable clip-on headphone.

FIG. 6 (a front view) shows slide rod guides 26, slide speaker rod guides 26, slide speaker rods 28, speaker 30 and speaker wire 32 interconnected to base piece and socket 24. The same embodiments are shown in FIG. 7 (a side view).

OPERATIONS

FIGS. 1-7

An adjustable clip-on headphone 8 shown in FIG. 1 utilizes a female clip 14. Crossover headband 10 made of spring steel or plastic utilizes male clips 12 that receive female clips 14. With male mount 12 and female clip 14 interconnected, adjustable clip-on headphone 8 can be used in a conventional manner. Female clip 14 can be disconnected from headband 10 and clipped to a baseball cap, sweatband or a wide variety of headwear preferred by the user. Base piece and socket 24 allows speaker 30 to pivot away from the user's ear at an angle perpendicular to the ear without removing speaker 30 from the head. Speaker 30 can rotate 360 degrees laterally to the ear on base piece and socket 24. A slide speaker rod 28 slides up and down on base piece and socket 24. Speaker 30 is attached to slide rods 28.

A plastic ball 16 shown in FIG. 2 is molded to female clip 14, forming a base piece 18.

Base piece 18 acts as a foundation for a spring 20 and a socket 22. Shown in exploded view FIG. 3, socket 22 is formed from two molded plastic halves that come together over base piece 18, compressing spring 20 against base piece 18 to prevent socket 22 from flopping around on base piece 18. Socket halves 22 are either molded or screwed together. Base piece 18, spring 20 and socket 22 form base piece and socket 24.

A top view of assembled base piece and socket 24 is shown in FIG. 4. Slide rod guides 26 are molded to socket 22. Socket 22 can pivot perpendicular to base piece 18 and can rotate 360 degrees laterally to base piece 18. Slide rods 28 shown in FIG. 5 (a side view) of base piece and socket 24 ride in guides 26.

FIG. 6 (a front view) shows how slide rods 28 made if spring steel ride in guides 26. The spring tension of the wishbone design hold slide rods 28 tight against guides 26. Slight pressure against the top of slide rods 28 allows for up and down adjustment along base piece and socket 24. Speaker 30 is screwed to slide rods 28, and speaker wire 32 attaches to any stereo in present use.

Speaker 30 connects to slide rod 28. Slide rod 28 rides in guides 26. Guides 26 are part of base piece and socket 24 as shown in FIG. 7 (a side view) of assembled adjustable clip-on headphones.

Accordingly, the advantages of this invention are:

(a) It eliminates the need for a crossover headband.

(b) It provides all the adjustment required for a limitless number of mounting alternatives.

(c) It allows the speakers to pivot, swivel or rotate without being removed from the type of headwear the user prefers.

Although the preceding description contains many specifications, it is not intended to limit the invention in any form or possible use. For instance, the clip could be an alligator type, or velcro might be used. The base piece and socket could be spring-loaded externally rather than internally. One speaker could be used instead of two. The speaker could be of the type that fits inside the user's ear. A single rod molded to the base piece and socket with a telescopic rod could be used.

Thus the scope of the invention should be determined by the appended claims and their legal equivalents, rather than by the examples given.

We claim:

1. A stereo headphone system comprising:

(a) A crossover headband equipped with male clip mounts and means to receive female clips mounts;

(b) said stereo headphone system equipped with female clips and means to be connected to said crossover headband;

(c) said female clips having means to disconnect from said crossover headband and means to clip onto an article of headwear other than said crossover headband;

(d) said stereo headphone system having a spring-loaded base piece and socket and means to rotate, swivel and pivot in any direction;

(e) said stereo headphones having speaker connecting rods and means for up and down adjusment.

* * * * *